United States Patent [19]

Siegwart

[11] Patent Number: 4,513,534

[45] Date of Patent: Apr. 30, 1985

[54] SHUTTER FOR VENTILATION SYSTEMS

[76] Inventor: Emil Siegwart, Michael-Blatter-Strasse 6, D-6603 Sulzbach-Neuweiler, Fed. Rep. of Germany

[21] Appl. No.: 169,726

[22] Filed: Jul. 17, 1980

[30] Foreign Application Priority Data

Jul. 21, 1979 [DE] Fed. Rep. of Germany ... 7920975[U]

[51] Int. Cl.[3] ..... E06B 7/08

[52] U.S. Cl. ..... 49/91; 49/92; 98/121.2

[58] Field of Search ..... 49/91, 92, 475, 371; 137/601; 98/121 A, 110

[56] References Cited

U.S. PATENT DOCUMENTS

| | | | |
|---|---|---|---|
| 2,390,227 | 12/1945 | Smith | 49/91 X |
| 3,110,936 | 11/1963 | Berard | 49/92 |
| 3,783,768 | 1/1974 | Caming et al. | 98/110 |
| 3,885,347 | 5/1975 | Adachi et al. | 49/92 |

*Primary Examiner*—Philip C. Kannan

*Attorney, Agent, or Firm*—Peter K. Kontler

[57] ABSTRACT

A louver type shutter for ventilation systems has hollow flaps which are pivotally mounted in a frame. Seals made from a foamed sheet material are located between the flaps and the frame and the front edges of the flaps are pressed directly into the foam sheet.

19 Claims, 2 Drawing Figures

SHUTTER FOR VENTILATION SYSTEMS

BACKGROUND OF THE INVENTION

The invention concerns a shutter, particularly a louver type shutter, for ventilation systems having at least one hollow flap which is pivotally mounted in a frame and further having a seal between the flap and the frame which is made from a foam sheet covered on the surface facing the frame with a thin coating of a material having a fairly good sliding capability.

A shutter of this type is known from German Utility Model No. 77 33 240. The Utility Model suggests in particular a number of variants of a seal which, like those in accordance with German Utility Model Nos. 76 28 312 and 77 33 239, is fitted on the outside of a toothed wheel seated on and capable of moving the flap and, in the case of a folding cover, coupling the flap with a neighboring flap.

A basic problem with these seals, also dealt with in the first-mentioned Utility Model, is in the contact pressure. Since all manufacturing defects, especially the unavoidable slight distortions of the metal frame, are absorbed by the foam sheet or seal, the average compression of the seal, and thus the contact pressure is sometimes excessible. The flap is then too slow-moving. This impairs its efficiency, particularly in the event of a power failure when it is supposed to close automatically by means of prestressed spiral springs which do not have the power of an electrical motor.

OBJECTS AND SUMMARY OF THE INVENTION

The invention intends to reduce the contact and displacement forces resulting from lateral sealing of the flap, especially the forces due to manufacturing defects.

According to the invention, this aim is fulfilled in a shutter of the type described at the outset by pressing the front edges of the hollow section of the flap directly into the foam sheet.

Instead of the whole area of the foam sheet being pressed as previously, the pressure is now, as it were, applied linearly. The contact force is thus reduced to a fraction for comparable deformations. The sealing effect is here in no way impaired. Since the flap is hollow and of elongated cross-section, two successive sealing points must be penetrated when the flap is closed before leakage can occur. In fact, the leakage rate is reduced by a factor of ten, that is, an extraordinary increase in the tightness of the shutter is achieved.

The above-mentioned toothed wheels present in the preferred folding flap construction are placed on the outside of a U-shaped frame where they are accommodated in the flat, outward-opening U-section of the frame and can be enclosed if necessary simply by covering this U-section. This separation of the toothed wheels from the flaps and their removal from the flow path brings further advantages. Thus, dirt forming a nutrient for bacteria tends to become trapped in the toothed rims. This is particularly undesirable in ventilation systems for hospitals, especially operating theatres, and also in pharmaceutical production centres. The shutters according to the invention are, however, physiologically unobjectionable.

In the case of hot-air supply pipes and the like, the toothed wheels remain cooler and are no longer stressed as a consequence of the fact that the coefficient of thermal expansion of the aluminium of which they are made is higher than that of the steel plate of the frame.

Finally, the second toothed wheel previously provided at the other end of the flap purely for sealing purposes can be dispensed with since it is not required for actuation and coupling of the flaps.

The flap is normally cut to size from a continuous section and the edges of the flaps are trimmed: they can also be slightly sharpened and/or rounded off.

In order to insure that the edges make a uniformly linear impression, the block which receives the shaft of the flap and is normally riveted to the front side of the hollow section, is set a few millimeters further in.

It is advantageous for the foam sheet to project 3–7 mm, preferably approximately 5 mm, beyond the long sides of the hollow section and to be essentially flush with both ends of the hollow section so that the seals of the individual flaps contact one another when the folding flap construction is closed.

In order to fix the seal accurately on the flap from the outset and to keep it secure, an advantageous embodiment of the invention provides centering devices which are secured and perferably stuck, to the foam sheet, and extend into the hollow section. The centering devices are preferably trapezoidal blanks made of the same sheet material as the foam sheet.

The appropriate thickness of the foam sheet is 3–7 mm, preferably approximately 5 mm. The preferred material is silicone rubber. The above-mentioned thin coating is preferably of Teflon®.

Finally, according to another advantageous embodiment of the invention, both the upstream and downstream portion of the above-mentioned frame, as considered in the flow direction, are bent slightly outward starting from that surface of the frame which contacts the flaps in the closed position thereof. With this design, the full contact force occurs only in the closed position of the flaps.

The drawing illustrates a form of construction of the invention.

DESCRIPTION OF THE PREFERRED EMBODIMENTS

Figure 1:
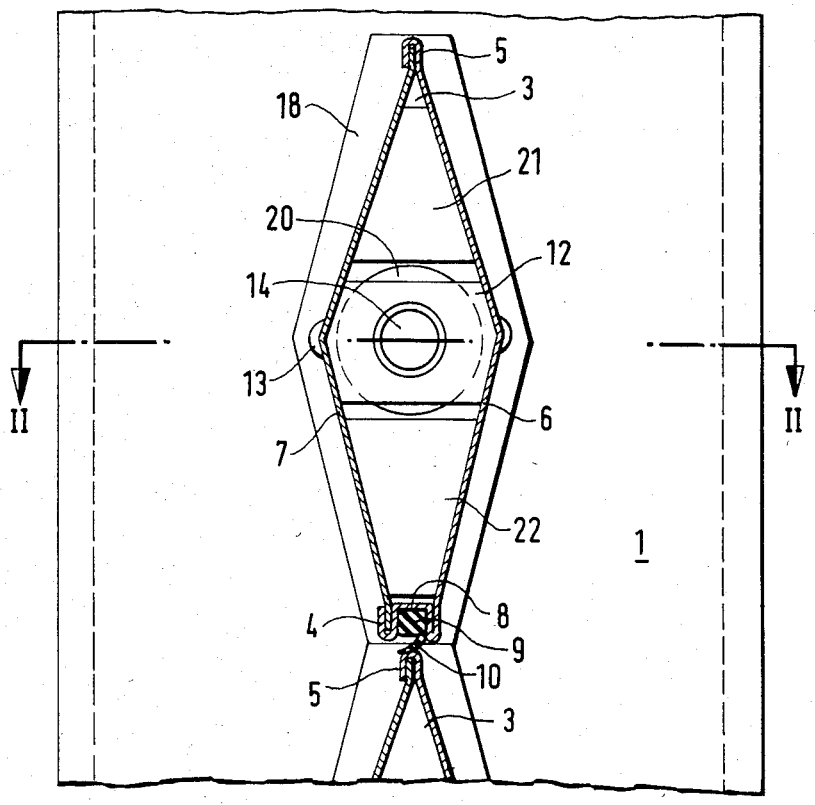
FIG. 1 shows a section through a shutter as seen in the direction of Arrow I in FIG. 2.
Figure 2:
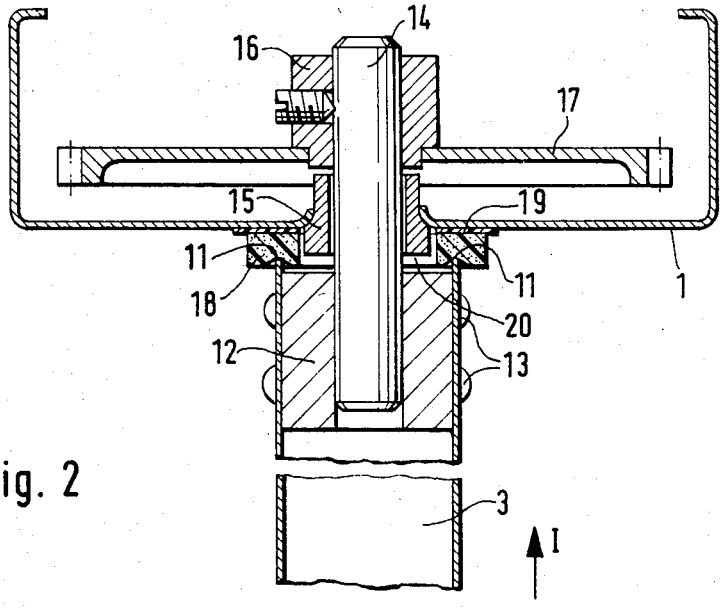
FIG. 2 shows a section along line II—II in FIG. 1.

A rectangular metal frame 1 supports several coplanar flaps 3 on parallel axes.

The metal frame 1 is in the form of a flat, outward-facing U-section.

The flaps 3 are hollow sections of two metal strips 6 and 7 which are slightly bent lengthwise and are connected at their edges by folds 4 and 5. Metal strip 6 has, in addition to fold 4, a groove 8 in which an elastic sealing section 9 is located. In the closed position illustrated, a lip 10 of the sealing section 9 rests against fold 5 of the neighboring flap 3.

At both ends of each flap 3, but at a few millimeters distance from the end edges 11, aluminium blocks 12 are inserted in the hollow flaps 3 and fixed thereto by rivets 13. An axle-end 14 is pressed into a drill-hole in each of these aluminium blocks 12.

The axle-end 14 extends across the metal frame 1 via an axle-box 15. A toothed wheel 17 is attached to the outer portion of the axle-end 14 by means of a fixing block 16 which can be screwed on. The toothed wheel 17 mates with that of the neighboring flap 3. By means of an actuator (not shown) which acts on a toothed wheel 17 or an axle-end 14, all the flaps 3 can be turned 90° from the closed position illustrated into the open position and back.

The flaps 3 are sealed against the metal frame 1 by diamond-shaped blanks 18 cut from 5 mm-thick silicone rubber foam. A thin Teflon® coating 19 (shown exaggeratedly thick in the drawing) is stuck to that side of each of the blanks 18 which faces the frame 1. Each blank 18 has a circular cut-out 20 into which the inner end of the axle-box 15 projects and through which the axle-end 14 passes. On the side facing the flap 3, the blank 18 has two trapezoidal centering devices 21 and 22 which are preferably stuck to the blank 18 and are made of the same silicone rubber foam. The centering devices 21 and 22 fit the internal cross-section of the hollow flap 3 and mate with it.

The end edges 11 of the flap 3 are pressed into the blanks 18 and press these against the metal frame 1. The pressure is great enough to guarantee excellent sealing. The contact force is nevertheless relatively small.

I claim:

1. A flow control unit for ventilation systems, particularly a louver-type unit, comprising a support; a flow regulating member mounted on said support for movement between an open and a closed position and spaced from said support so as to define a gap therewith; and a resilient sealing member in said gap in sliding contact with said support, said flow regulating member being impressed into said sealing member and engaging the latter so that said sealing member moves with said flow regulating member during displacement of said flow regulating member between said open and closed positions.

2. A flow control unit as defined in claim 1, wherein said flow regulating member is pivotally mounted on said support.

3. A flow control unit as defined in claim 1, wherein said sealing member is sheet-like.

4. A flow control unit as defined in claim 1, wherein said flow regulating member is in direct contact with said sealing member.

5. A flow control unit as defined in claim 1, said flow regulating member having a pair of longitudinally spaced ends; and wherein said sealing member is approximately flush with said ends.

6. A flow control unit as defined in claim 1, wherein said support comprises a frame.

7. A flow control unit as defined in claim 1, said flow regulating member being hollow and having edges which bound the cross section thereof; and wherein said edges are impressed into said sealing member.

8. A flow control unit as defined in claim 7, said edges including a pair of longitudinal edges; and wherein said sealing member projects to either side of said longitudinal edges by about 3 to 7 mm.

9. A flow control unit as defined in claim 8, wherein said sealing member projects to either side of said longitudinal edges by about 5 mm.

10. A flow control unit as defined in claim 9, wherein said sealing member is provided with a centering member which is received in the interior of said flow regulating member.

11. A flow control unit as defined in claim 10, wherein said centering member is secured to said sealing member.

12. A flow control unit as defined in claim 10, wherein said sealing and centering members are composed of the same material.

13. A flow control unit as defined in claim 10, said cross section being diamond-shaped, and wherein said sealing member is provided with a pair of trapezoidal centering members.

14. A flow control unit as defined in claim 1, wherein said sealing member comprises a foamed material.

15. A flow control unit as defined in claim 14, wherein said foamed material is silicone rubber.

16. A flow control unit as defined in claim 1, wherein said sealing member comprises a foil which engages said support and has a relatively low coefficient of sliding friction.

17. A flow control unit as defined in claim 16, wherein said foil comprises Teflon®.

18. A flow control unit as defined in claim 1, wherein said sealing member has a thickness of about 3 to 7 mm.

19. A flow control unit as defined in claim 18, wherein said thickness is about 5 mm.

* * * * *